US006353425B1

(12) United States Patent
Mosier

(10) Patent No.: US 6,353,425 B1
(45) Date of Patent: Mar. 5, 2002

(54) METHOD AND APPARATUS FOR PROVIDING SEPARATE PRIMARY COLOR SELECTION ON AN ACTIVE MATRIX LIQUID CRYSTAL DISPLAY

(75) Inventor: Donald E. Mosier, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 09/272,924

(22) Filed: Mar. 19, 1999

(51) Int. Cl.[7] ..... G09G 3/36; G09G 5/00
(52) U.S. Cl. ..... 345/88; 345/98; 345/204
(58) Field of Search ..... 345/204, 214, 345/99, 100, 98, 87, 88, 89

(56) References Cited

U.S. PATENT DOCUMENTS 4,642,628 A * 2/1987 Murata ..... 340/784
RE33,882 E * 4/1992 Morozumi ..... 340/70
5,523,772 A * 6/1996 Lee ..... 345/100
6,008,801 A * 12/1999 Jeong ..... 345/100
6,097,362 A * 8/2000 Kim ..... 345/100
6,191,765 B1 * 2/2001 Mano et al. ..... 345/88

OTHER PUBLICATIONS

Application Serial No. 08/721,070 filed Sep. 26, 1996, Entitled "Method And Apparatus For Providing Separate Primary Color Selection On An Active Matrix Liquid Crystal Display" D.E. Mosier.

* cited by examiner

*Primary Examiner*—Bipin Shalwala
*Assistant Examiner*—David L. Lewis
(74) *Attorney, Agent, or Firm*—Nathan O. Jensen; Kyle Eppele

(57) ABSTRACT

The column driver for a liquid crystal display (LCD) provides separate analog signals to each color element associated with the pixel. For example, a separate analog signal is provided to a red element, a blue element, and a green element. The driver circuit receives a digital signal representative of the gray scale voltage and provides the analog signal through a switch matrix to each color element. The driver circuit reduces undesirable color shifts as gray scale values are varied.

13 Claims, 3 Drawing Sheets

METHOD AND APPARATUS FOR PROVIDING SEPARATE PRIMARY COLOR SELECTION ON AN ACTIVE MATRIX LIQUID CRYSTAL DISPLAY

CROSS REFERENCE TO RELATED APPLICATIONS

The present application is related to U.S. application Ser. No. 08/721,070 filed Sep. 26, 1996, by Mosier, entitled "Method and Apparatus for Monitoring LCD Driver Performance".

FIELD OF THE INVENTION

The present invention relates generally to a display driver for a visual display. More particularly, the present invention relates to a circuit that provides drive signals to a color display, such as, a liquid crystal display (LCD).

BACKGROUND OF THE INVENTION

In conventional display systems, such as, color liquid crystal display (LCD) systems, a matrix of pixels can provide static or dynamic visual images in color. Each pixel is typically comprised of three primary color elements, such as, a red element, a green element, and a blue element. Each color element is controlled by an associated transistor. The matrix of pixels is associated with a matrix of transistors, such as, thin film transistors (TFTs) arranged in rows and columns.

A column line is coupled to the drain or source associated with each transistor in each column. A row line is coupled to the gate associated with each transistor in each row. A row of transistors is activated by providing a gate control signal to the associated row line. The gate control signal turns on each transistor in the row. Each transistor in the row provides an analog voltage associated with its column line to cause the color element to emit a particular amount of light. Generally, a column driver circuit selects from the same set of analog voltages to provide an analog voltage for each color element in the display (e.g., the three color elements in each pixel each receive one analog voltage level from the same set of voltage levels). The analog voltage is provided to the column line so that the appropriate amount of light, e.g., color is emitted by each pixel.

Transmission versus voltage characteristics for the three color elements (e.g., the primary color elements) vary from each other. Accordingly, conventional systems which utilize the same voltages to drive the three color elements can be susceptible to undesirable color shifts. The undesirable color shifts are ascertainable as the analog voltages or gray scale values for each pixel are varied. Gray scale values refer to the range from darkness to lightness for each pixel or color element on a display.

Conventional LCDs attempt to reduce color-shift problems by having a large number of gray scale values (large gray scale capability). With such a scheme, a particular gray scale value can be selected from the large number of gray scale values available to yield the closest match to a desired response for the particular color being driven on the LCD. However, this technique creates a computational burden on the graphic system because the gray scale signal for each pixel must be individually processed to determine which gray scale value provides the most appropriate response. Further, this technique forces a compromise between the actual response and the desired response. This technique is also disadvantageous because it requires that a large number of gray scale values be available, thereby making the voltage driver larger, more complex, more costly, and less power efficient.

Thus, there is a need for a voltage driver circuit for a display that is not as susceptible to undesirable color shifts. Further, there is a need for a LCD which does not utilize the same analog voltage for each primary color element. Further still, there is a need for a new method of driving primary colors separately to provide a full set of gray scale values.

SUMMARY OF THE INVENTION

The present invention relates to a driver for a color display having an array of pixels. Each pixel includes a first color element, a second color element, and a third color element that is coupled to a first set of color terminals, a second set of color terminals, and a third set of color terminals, respectively. The driver includes an input circuit and a control circuit. The input circuit includes a first set of input terminals, a second set of input terminals, and a third set of input terminals. The first set of input terminals receives first color signals indicative of first gray scales for the first color element. The second set of input terminals receives second color signals indicative of second gray scales for the second color element, and the third set of input terminals receives third color signals indicative of third gray scales for the third color element. The control circuit is coupled to the input circuit and provides first analog signals in accordance with the first gray scales to the first set of color terminals. The control circuit also provides second analog signals in accordance with second gray scales to the second set of color terminals and provides third analog signals in accordance with the third gray scales to the third set of color terminals.

The present invention further relates to a voltage driver circuit for a color liquid crystal display having an array of transistors arranged in at least a first row, a second row, a first color 1 column, a first color 2 column, a first color 3 column, a second color 1 column, a second color 2 column, a second color 3 column. Transistors in the first color 1 column are coupled to a first color 1 column line; the transistors in the second color 1 column are coupled to a second color 1 column line, and the transistors in the first color 2 column are coupled to a first color 2 column line. The transistors in the second color 2 column line are coupled to a second color 2 column line, the transistors in the first color 3 column are coupled to a first color 3 column line, and the transistors in the second color 3 column are coupled to a second color 3 column line. The voltage driver circuit includes an input circuit and a control circuit that is coupled to the input circuit. The input circuit functions for receiving a first color 1 signal for the first color 1 column line, for receiving a first color 2 signal for the first color 2 column line, for receiving a first color 3 signal for the first color 3 column line, for receiving a second color 1 signal for the second color 1 column line, for receiving a second color 2 signal for the second color 2 column line, and for receiving a second color 3 signal for the second color 3 column line. The control circuit provides a first analog color 1 signal in accordance with the first color 1 signal, a first analog color 2 signal in accordance with the first color 2 signal, a first analog color 3 signal in accordance with the first color 3 signal, a second analog color 1 signal in accordance with the second color 1 signal, a second analog color 2 signal in accordance with the second color 2 signal, and a second analog color 3 signal in accordance with the second color 3 signal.

The present invention still further relates to a color liquid crystal display including an array of transistor and a control means. The array of transistors is arranged in at least a first row, a second row, a first red column, a first green column, a first blue column, a second red column, a second green column, and a second blue column. The transistors in the first red column are coupled to a first red column line; the transistors in the second red column are coupled to a second red column line, and the transistors in the first green column are coupled to a first green column line. The transistors in the second green column are coupled to a second green column line; the transistors in the first blue column are coupled to a first blue column line, and the transistors in the second blue column are coupled to a second blue column line. The control means provides a first analog red signal in accordance with a first red level, a first analog green signal in accordance with a first green level, a first analog blue signal in accordance with a first blue level, a second analog red signal in accordance with a second red level, a second analog green signal in accordance with a second green level, and a second analog blue signal in accordance with a second blue level.

BRIEF DESCRIPTION OF THE DRAWINGS

The present invention will hereafter be described with reference to the accompanying drawings, where ever like numerals denote like elements and.

DESCRIPTION OF PREFERRED EXEMPLARY EMBODIMENTS OF THE PRESENT INVENTION

Figure 1:
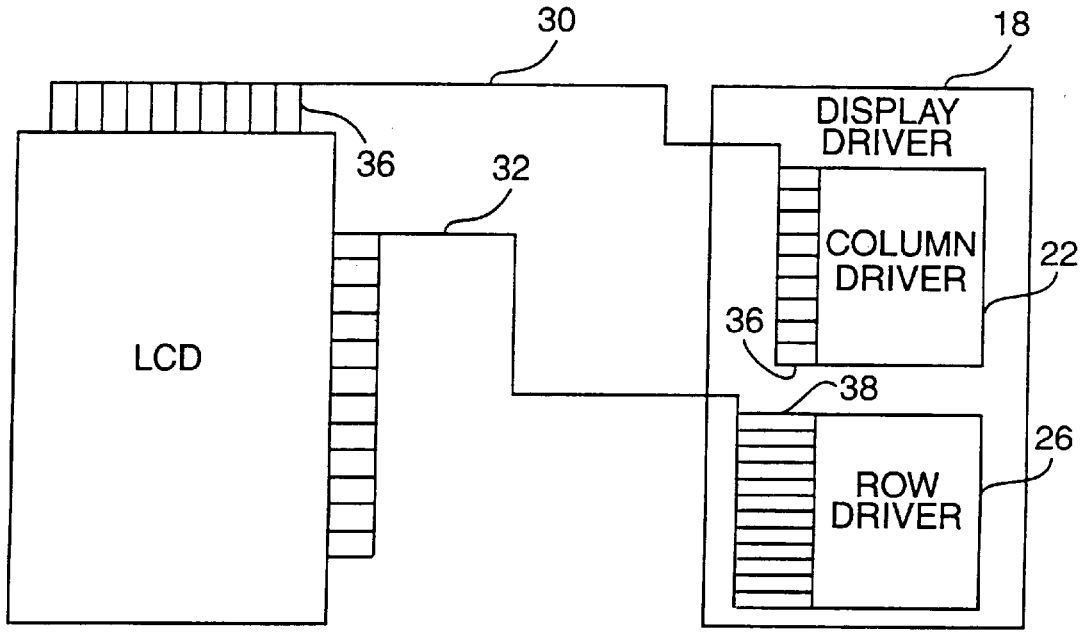
FIG. 1 is an exemplary block diagram of a visual display system including a column driver in accordance with the exemplary embodiment of the present invention.

With reference to FIG. 1, a display system 10, such as, a color liquid crystal display (LCD), includes a display 14 and a driver circuit 18. Driver circuit 18 includes column driver circuit 22 and row driver 26. Driver circuit 18 provides electronic signals to cause display 14 to provide visual indicia. The visual indicia can be dynamic or static images.

Display 14 is preferably a color twisted-nematic LCD having 640×480 or 1024×768 pixels. Each pixel can be comprised of three LCD elements, one for each color (e.g., red, green, and blue), as described in more detail with reference to FIG. 2. The LCD can be a normally transparent (white) or a normally opaque (black) display.

Display 14 preferably includes an array of transistors, such as, thin film transistors (TFTs), provided over an LCD cell. The array of transistors is utilized to manipulate liquid crystals in display 14 to appropriately cause colors to be provided on display 14. Display 14 is exemplary shown in FIG. 1 as having 13 rows and 11 columns.

The transistors are arranged in rows and columns. The transistors have one drain/source coupled to liquid crystal display elements, and the other drain/source is coupled to a column conductor or line 36. The gate of the transistors is coupled to one of the row lines 38. The column lines 36 are coupled to column driver 22 via bus 30. The row lines 38 are coupled to row driver 26 via bus 32. Column line 36 includes three column lines or conductors 62, 64, and 66, one for each color element, as described below with reference to FIG. 2.

Row driver 26 activates rows of transistors through signals provided across row bus 32 on row lines 38. When a row is turned on, voltages from column lines 36 are provided to the liquid crystal display cell. Depending upon the magnitude of the voltage on the column, the pixel or element associated with the transistor in the selected row and in the selected column will emit a level of light. Column driver 22 and row driver 26 cooperate to ensure that the proper pixels or elements emit the proper amount of light to create the visual indica. For example, column driver 22 can provide voltage signals from zero to six volts at any number of voltage levels. Generally, the larger the number of different voltage levels, the greater the number of different levels of light (gray scales) that can be provided from the LCD element.

Figure 2:
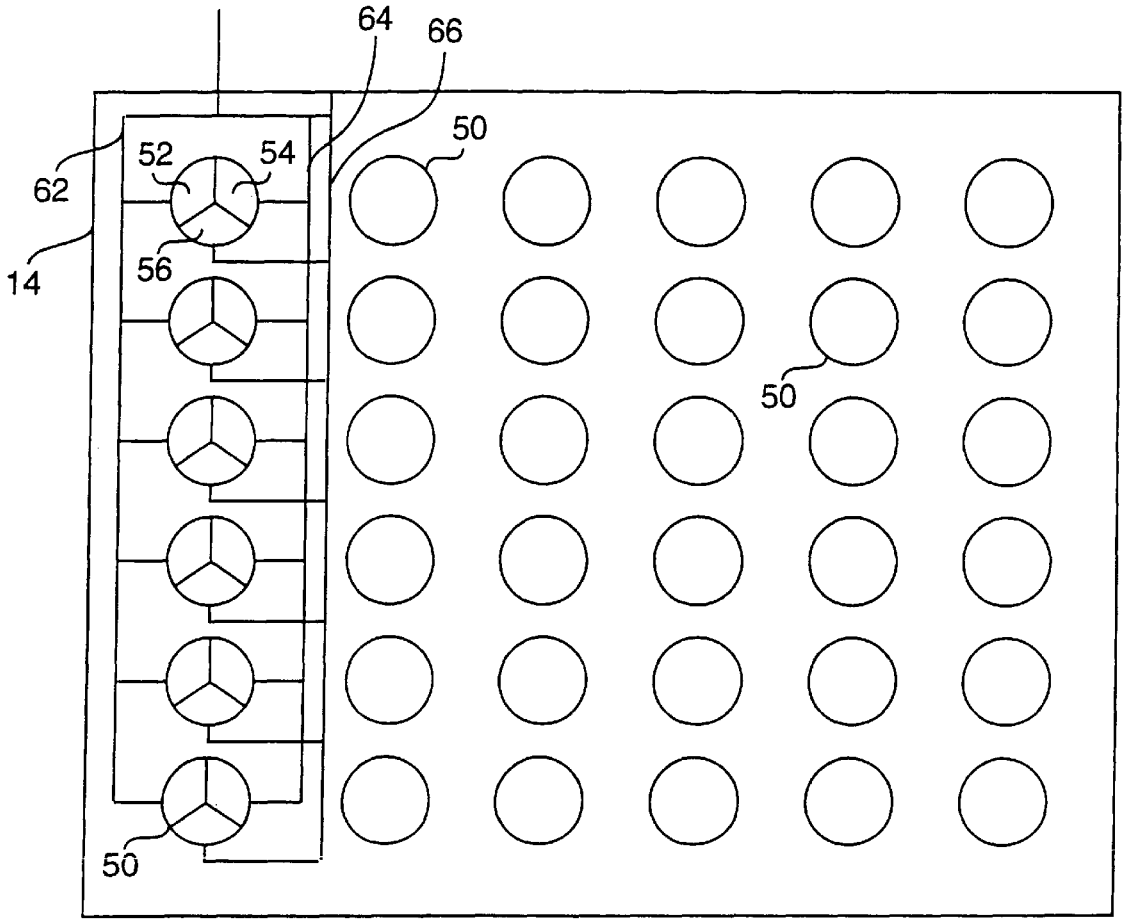
FIG. 2 is a more detailed exemplary block diagram of the display illustrated in FIG. 1.

With reference to FIG. 2, display 14 is comprised of pixels 50. Column line 36 includes column conductors 62, 64, and 66. Each pixel 50 includes a red element 52, a green element 54, and a blue element 56. Conductors 62, 64, and 66 are coupled to transistors associated with red element 52, green element 54, and blue element 56, respectively. Display 14 is exemplary shown having an array of 6×6 pixels 50.

Figure 3:
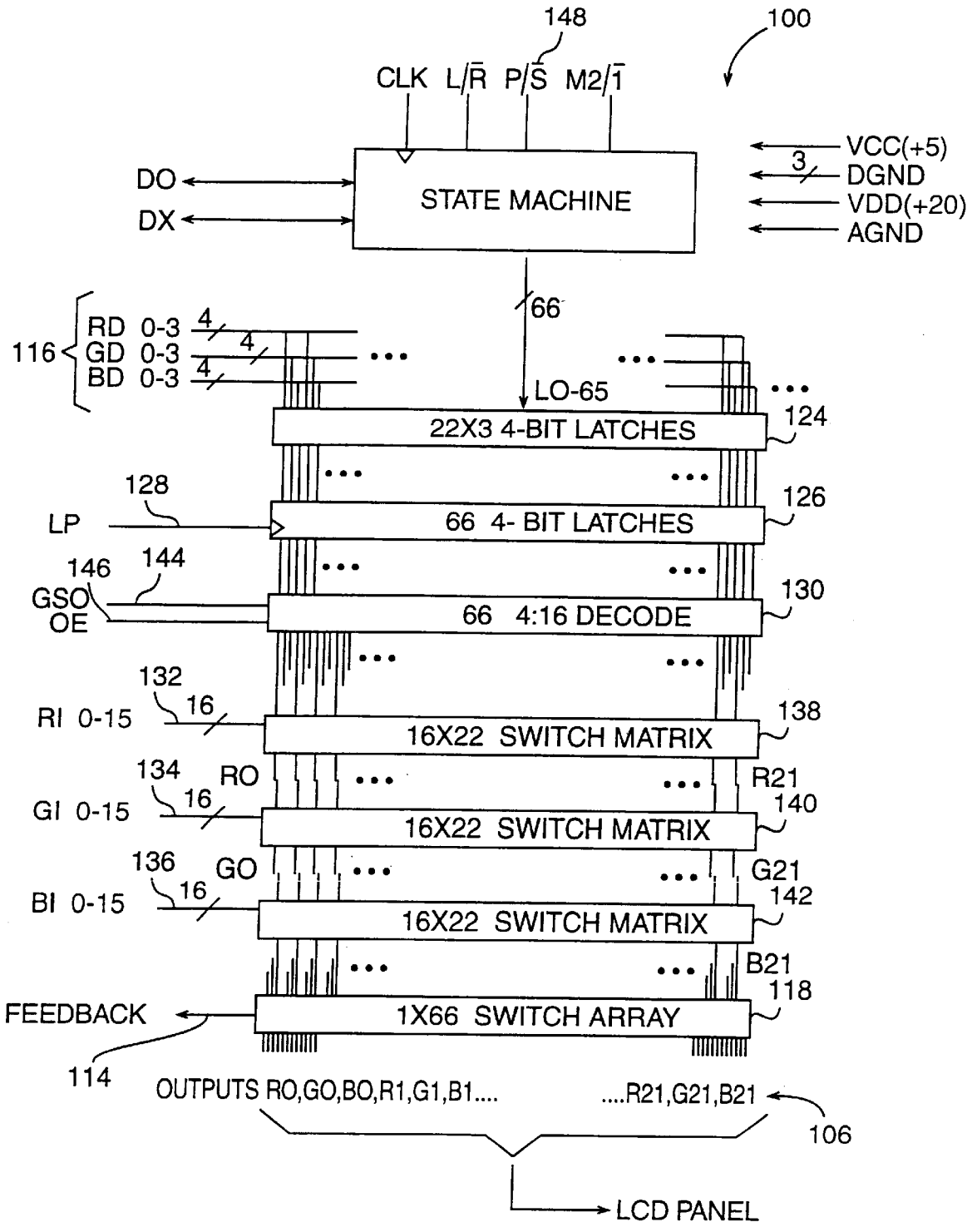
FIG. 3 is an electrical schematic block diagram of the driver circuit illustrated in FIG. 1.

Referring now to FIG. 3, a preferred LCD column driver circuit 22 arrangement is shown as 100. Arrangement 100 is shown for use with a twenty-two column display 14 (FIG. 1). However, any number of column displays can be utilized.

Driver arrangement 100 receives input data at input terminals 116. Terminals 116 receive the input data as three sets of 22 four-bit signals (e.g., one set for each color). The input data is stored in a first set of 66 4-bit latches 124. The input data is representative of the gray scale for each of elements 52, 54, and 56 (FIG. 2).

After an entire group of data is collected, it is transferred to a second set of latches 126, as controlled by an LP input control signal 128. Each of these 4-bit values is decoded with a 4:16 decoder 130 into 16 control lines for selecting one of 16 analog input voltages from the sets of voltages 132, 134, and 136, with each set reserved for controlling either red, green, or blue display elements 52, 54, or 56 and controlled by corresponding switch matrices 138, 140, and 142. Thus, arrangement 100 has a separate set of analog voltages for each color.

The outputs of the decoder 130 are interleaved such that every third output uses the red voltages 132, with the green and blue voltages (134 and 136, respectively) used in turn. The 4:16 decoder 130 also has provisions for forcing all outputs to either the zero state or to an open state upon receipt of the GSO and OE signals 144 and 146, respectively. All switches in the matrices (138, 140, and 142) must be driven to an open state during the LP data transition to ensure that internal shorting between gray scale voltages is never present. Internal circuitry may be included to perform this "break-before-make" function without the use of the external OE signal 146.

Data may be loaded into the first latch register group 124 in several different ways, depending on the requirements of the external controller (not shown). The configuration depicted in FIG. 3 has been chosen specifically to be as flexible as possible, being adaptable to a large number of different controller types.

When the P/S signal associated with a state machine 148 is high, the red, green, and blue data values are read in parallel, with three 4-bit values loaded at every clock pulse. Either 22 or 21 data sets are loaded, depending on the state of the M2/1 control lines. If this signal is high, all 22 sets of data are loaded, with the carry-out signal being activated at the 23rd input. If M2/1 is low, only 21 sets of data are loaded, with the carry-out signal activated at the 22nd input.

In this case, outputs R21, G21, and B21 are not used. The switch between 22 and 21 data pairs is included to allow three drivers in combination to drive 192 column lines with properly coordinated carry-out signals.

If the P/S control line is low, then a single 4-bit data value is loaded for each clock pulse. A total of 64 values are loaded when M2/1 is low, with the carry-out signal being active at the 65th input such that the 65th data value would be loaded into a cascaded driver. Outputs G21 and B21 are not used. When M2/1 is high, all 66 values are loaded, and all outputs are used. When used in either of these modes, the three sets of data inputs may be externally connected in parallel to reduce the external circuitry requirements. However, all the internal data paths are maintained.

The L/R lines are used to determine the sequence in which data is loaded. When L/R is low, the data is loaded, starting with L0 and proceeding with successively higher numbers. D0 is the input signal which initiates loading, with DX being the carry-out signal. When L/R is high, DX is the initiating input, D0 is the carry out, and the data loading starts at the appropriately higher value and proceeds to zero.

An additional switch array 118 is used to allow the external monitoring of any one of the 66 output drive lines 106 in accordance with the present invention. When the LP line 128 is high, the 7-bit value present on the RD 0–2 and GD 0–3 input data lines (RD2=MSB, GD0=LSB) at the falling edge of the clock CLK is loaded into a feedback control register. This value is then used to select a single output drive line 106, which is thereby connected to the feedback line 114. Thus, selective control of the switch array 118 may be based upon the RD, GD, and BD data lines 116 and the state of the LP line 128. The feedback switch array 118 may be physically located adjacent to the die outputs on which the LCD driver 100 is fabricated to maximize monitoring coverage. "Break-before-make" provisions must also be provided for this switch array 118 to prevent internal shorting between gray scale voltages.

Arrangement 100 as display driver 18 can be implemented as a custom-designed integrated circuit. Alternatively, arrangement 100 can be configured in software or hardware by utilizing ASIC devices. For example, digital portions of a control circuit associated with arrangement 100 can be implemented in an ASIC or programmable logic device. Generally, digital signals are provided between state machine 148, input terminals 116, and switch matrices 138, 140, and 142. Analog signals are provided to switch matrixes 138, 140, and 142 by resistor ladders or arrays of digital-to-analog converters. Switch matrices 138, 140, and 142 operate to select an analog signal or gray scale signal representative of the amount of brightness to be provided by each of elements 52, 54, and 56. The outputs of switch matrices of 138, 140, and 142 are preferably coupled to respective column conductors 62, 64, and 66 via column line 36.

Arrangement 100 advantageously selects a separate analog gray scale value for each of elements 52, 54, and 56. Although examples of 16 gray scale levels for red, green, and blue are disclosed, other schemes may include 25, 30, or more voltage levels for each color. Arrangement 100 can process the digital data as a continuous stream and sequentially apply analog voltages to display 14.

It is understood that, while the detailed drawings, specific examples and particular components given described preferred exemplary embodiments of the present invention, they are for the purpose of illustration only. The apparatus and method of the present invention are not limited to the precise details disclosed. Single lines in the drawings can represent multiple conductors. For example, although an analog generation circuit including a digital-to-analog converter and resistor ladder are discussed, other types of analog generation circuits can be provided. Thus, changes may be made to the details disclosed without departing from the spirit of the invention, which is defined by the following claims.

I claim:

1. A driver for a color display having an array of pixels, the pixels each being comprised of a first color element, a second color element, and a third color element, wherein said first color element, said second color element and said third color element are each adapted and configured for producing different color with respect to each other; the first color element being coupled to a first set of color terminals only, the second color element being coupled to a second set of color terminals only, and the third color element being coupled to a third set of color terminals only, the driver comprising:

an input circuit including a first set of input terminals, a second set of input terminals, and a third set input terminals, the first set of input terminals receiving first color signals indicative of first gray scales for the first color element, the second set of input terminals receiving second color signals indicative of second gray scales for the second color element, the third set of input terminals receiving third color signals indicative of third gray scales for the third color element;

a control circuit coupled to the input circuit, the control circuit providing a first set of analog signals in accordance with the first gray scales only to the first set of color terminals, the control circuit providing a second set of analog signals in accordance with the second gray scales only to the second set of color terminals, and the control circuit providing a third set of analog signals in accordance with the third gray scales only to the third set of color terminals; and wherein said first set of analog signals, said second set of analog signals and said third set of analog signals are separate sets of analog signals and are selected from independent sets of analog voltages where each of the independent sets is dedicated to a single color and associated with only one of said first, second and third sets of color terminals.

2. The driver of claim 1, wherein the control circuit includes a resistive ladder or a digital-to-analog converter for generating the first, second, and third sets of analog signals.

3. The driver of claim 2, wherein the first, second, and third color signals are digital signals.

4. The driver of claim 3, wherein the control circuit further comprises:

a decoder coupled to the input circuit to receive the first, second, and third color signals and to produce decoded signals; and a switch matrix selecting analog input signals in response to the decoded signals to provide the first, second, and third sets of analog signals.

5. The driver of claim 1, wherein the input circuit includes a serial latch.

6. The driver of claim 5, wherein the first, second, and third sets of analog signals are between 0 and 6 V.

7. The driver of claim 6, wherein the first color element provides red light, the second color element provides blue light, and the third color element provides green light.

8. A voltage driver circuit for a color liquid crystal display having an array of transistors arranged in at least a first row, a second row, a first color 1 column, a first color 2 column, a first color 3 column, a second color 1 column, a second color 2 column, and a second color 3 column, the transistors in the first color 1 column being coupled to a first color 1 column line, the transistors in the second color 1 column being coupled to a second color 1 column line, the transistors in the first color 2 column being coupled to a first color 2 column line, the transistors in the second color 2 column being coupled to a second color 2 column line, the transistors in the first color 3 column being coupled to a first color 3 column line, the transistors in the second color 3 column being coupled to a second color 3 column line, the voltage driver circuit comprising:

an input circuit for receiving a first color 1 signal for the first color 1 column line, for receiving a first color 2 signal for the first color 2 column line, for receiving a first color 3 signal for the first color 3 column line, for receiving a second color 1 signal for the second color 1 column line, for receiving a second color 2 signal for the second color 2 column line, and for receiving a second color 3 signal for the second color 3 column line;

a control circuit coupled to the input circuit, the control circuit providing a first analog color 1 signal in accordance with the first color 1 signal, providing a first analog color 2 signal in accordance with the first color 2 signal, providing a first analog color 3 signal in accordance with the first color 3 signal, providing a second analog color 1 signal in accordance with the second color 1 signal, providing a second analog color 2 signal in accordance with the second color 2 signal, and providing a second analog color 3 signal in accordance with the second color 3 signal;

wherein said color 1, said color 2, and said color 3 are each different colors; and wherein said analog color 1 signals in accordance with said color 1 signals are selected from a first gray scale voltage set, said analog color 2 signals in accordance with said color 2 signals are selected from a second gray scale voltage set which is independent from said first gray scale voltage set.

9. The voltage driver circuit of claim 8, wherein the control circuit is a customized integrated circuit.

10. The voltage driver circuit of claim 8, wherein the circuit is integrated with the display.

11. The voltage driver circuit of claim 8, wherein the control circuit includes an analog voltage means for producing the first analog color 1 signal, the second analog color 1 signal, the first analog color 2 signal, the second analog color 2 signal, the first analog color 3 signal, and the second analog color 3 signal.

12. The voltage driver circuit of claim 11, wherein the control circuit includes a switch matrix for selecting the first analog color 1 signal, the second analog color 1 signal, the first analog color 2 signal, the second analog color 2 signal, the first analog color 3 signal, and the second analog color 3 signal.

13. The voltage driver of claim 8, wherein color 1 is red, color 2 is blue, and color 3 is green.

* * * * *